United States Patent [19]

McAuley et al.

[11] Patent Number: 4,708,212

[45] Date of Patent: Nov. 24, 1987

[54] METHOD AND APPARATUS FOR OPTIMIZING DETERMINATION OF THE ORIGINATING DEPTH OF BOREHOLE CUTTINGS

[75] Inventors: James A. McAuley, Dallas; Susan G. Eppler, Garland, both of Tex.

[73] Assignee: TTE Holding Corp., Dallas, Tex.

[21] Appl. No.: 836,084

[22] Filed: Mar. 4, 1986

[51] Int. Cl.[4] ..... E21B 44/00

[52] U.S. Cl. ..... 175/42; 73/151.5; 175/48

[58] Field of Search ..... 175/38, 40, 42, 45, 175/48, 207; 73/151.5, 155; 166/53, 64, 113

[56] References Cited

U.S. PATENT DOCUMENTS

| | | | |
|---|---|---|---|
| 3,477,526 | 11/1969 | Jones et al. | 175/38 |
| 3,541,852 | 11/1970 | Brown et al. | 73/151.5 |
| 4,290,305 | 9/1981 | Gibson et al. | 73/155 |
| 4,401,169 | 8/1983 | Neshyba | 175/42 |

FOREIGN PATENT DOCUMENTS

| | | | |
|---|---|---|---|
| 2024895 | 1/1980 | United Kingdom | 175/48 |
| 2106961 | 4/1983 | United Kingdom | 175/38 |

*Primary Examiner*—James A. Leppink
*Assistant Examiner*—Hoang C. Dang
*Attorney, Agent, or Firm*—Kanz, Scherback & Timmons

[57] ABSTRACT

Lag-determining method and apparatus which provides for determination of and an indication of when borehole cuttings from preselected depths arrive at the surface of the earth is disclosed and includes devices for inputting the value of the lag strokes and the predetermined drilling depth increments. A signal representative of the actual drilling depth is provided to a computer circuitry. Counter circuitry accumulates a count of the strokes of the positive displacement mud pump. Adder circuitry sums the lag strokes and the accumulated count of the mud pump. Comparator circuitry provides an output when the compared values of the accumulated number of strokes of the positive displacement mud pump equals the sum of the lag strokes and the strokes of the positive displacement mud pump at a predetermined depth plus the depth increment. Visual and audio indications provide notification of the arrival of borehole cuttings from preselected depths.

17 Claims, 3 Drawing Figures

METHOD AND APPARATUS FOR OPTIMIZING DETERMINATION OF THE ORIGINATING DEPTH OF BOREHOLE CUTTINGS

BACKGROUND OF THE INVENTION

1. Field of the Invention

The present invention relates in general to a new and improved method and apparatus for use in drilling boreholes into subsurface formations. More particularly, the present invention relates to a new and improved method and apparatus for use in determining and monitoring the downhole depth from which borehole cuttings are removed and are being received at the surface of the drilling location 2. Description of the Prior Art It is known that when drilling a well, particularly those related to the rotary drilling of an oil or a gas well, a fluid—often called "drilling mud"—is injected into the drill pipe assembly from the surface of the earth. The fluid, or mud, is pumped downwardly through the drill pipe assembly to the bottom of the borehole, where it passes through the orifices in the drill bit and then flows upwardly toward the surface of the earth through the annular space between the drilling pipe assembly and the wall of the borehole. Upon the return of the mud to the surface of the earth, the mud is passed through a shaker screen which momentarily retains the stony refuse material (borehole cuttings) for evaluation and the mud is gathered in a storage tank from which the mud is reintroduced to the drilling pipe assembly. The drilling mud is commonly circulated and partially retained in the borehole for various reasons, as for example, to exert hydrostatic pressure to keep the subsurface pressure substantially sealed in the borehole and to remove the borehole cuttings from the bottom of the borehole up to the surface of the earth.

When an oil well is being drilled, one of the first methods of evaluating the exploratory activity is to look at the borehole cuttings and examine them from a geological point of view, as for example, what age are the cuttings, what type of rock is in the cuttings, do the cuttings contain a hydrocarbon, etc. When examining and evaluating the borehole cuttings, it is important to know the depth from which the borehole cuttings were removed from the earth. It will be appreciated that the borehole cuttings at the bottom of the borehole do not instantly appear at the surface of the earth but appear at the surface at some later time depending upon such things as the depth of the drill bit at the time the borehole cuttings are brought into existence from the action of the drill bit against the earth, the rate of the flow of the drilling mud, etc.

In the prior art, one method used to determine the depth from which the borehole cuttings originated is to stop the descent of the drill bit, introduce a predetermined amount of carbide into the downhole flow of drilling mud, record the time of the introduction of the carbide, monitor the discharge of the drilling mud at the surface of the earth for the presence of acetylene gas and record the time at which the presence of the acetylene gas occurs. The total elapsed time provides the time required for the drilling mud to traverse the round trip to the bottom of the borehole and back to the surface of the earth. Since the inside volume of each section of drill pipe is known, the total inside volume of the drill pipe down to any depth is known or can be easily calculated. The output of the mud pump at certain predetermined speeds is known (or may be determined at any particular speed of operation) so the amount of time required for, the mud pump to pump the carbide down to the drill bit (and the borehole cuttings) may be calculated. The amount of time can also be considered as the time necessary for the mud pump to pump sufficient mud to fill the inside volume of the drill pipe down to the drill bit. The time required for the borehole cuttings at the drill bit to travel to the surface of the earth from the drill bit (or place of origination) is equal to the total elapsed time minus the time required for the carbide to travel down to the drill bit. If the round trip for the drilling mud took one hour and twenty minutes at a depth of five thousand feet and the calculated time for the carbide to reach the drill bit was twenty minutes, then the borehole cuttings from that general depth would take approximately one hour to travel from the bottom of the borehole to the surface of the earth where the borehole cuttings could be observed. The time required for the borehole cuttings at the bottom of the borehole to reach the surface of the earth is known as the lag time. Obviously, this method depends on constant and continuous pumping of the mud pump.

The present invention as claimed is intended to provide a method and apparatus which eliminates many of the prior art deficiencies which include the necessity to operate the mud pump or mud pumps at the same speed at all times which includes during the calibration or initialization of the determination of the lag time, during the time borehole cuttings are being brought to the surface of the earth to be evaluated, etc. If the mud pump or mud pumps are not operated at the same speed at the times associated with the determination of the lag time then error will be introduced into the determination of the lag time. In the prior art, it is necessary to monitor and maintain a record, mental or written, of the time or times associated with the determination of lag time. In the prior art, lag time is a function of time and requires the measurement of time.

SUMMARY OF THE INVENTION

The present invention provides a method and apparatus for determining when and providing an indication of when the borehole cuttings from preselected depths arrive at the surface of the earth for examination and evaluation. Switches provide inputs representing the lag strokes and the predetermined drilling depth increment. A signal representative of the actual drilling depth is provided to a computer circuitry. Counter circuitry accumulates a count of the strokes of the positive displacement mud pump. Adder circuitry sums the lag strokes and the accumulated count of the mud pump. Comparator circuitry provides an output when the compared values of the accumulated number of strokes of the positive displacement mud pump equals the sum of the lag strokes and the strokes of the positive displacement mud pump at a predetermined depth plus the depth increment. Visual and audio indications provide notification of the arrival of borehole cuttings from preselected depths.

Among the advantages offered by the present invention are circuitry which automatically determines when and automatically provides an indication when the borehole cuttings from preselected depths arrive at the surface of the earth for examination and evaluation. The present invention eliminates the need to operate the mud pumps at the same speed during the drilling operation. The present invention allows any necessary number of mud pumps to be operated during the drilling operation. It is not necessary to keep a record of time during the operation.

Examples of the more important features and advantages of this invention have thus been summarized rather broadly in order that the detailed description thereof that follows may be better understood and in order that the contribution to the art may be better appreciated. There are, of course, additional features of the invention that will be described hereinafter and which will also form the subject of the claims appended hereto. Other features of the present invention will become apparent with reference to the following detailed description of a presently preferred embodiment thereof in connection with the accompanying drawing, wherein like reference numerals have been applied to like elements in which:

DESCRIPTION OF THE PREFERRED EMBODIMENT

Figure 1:
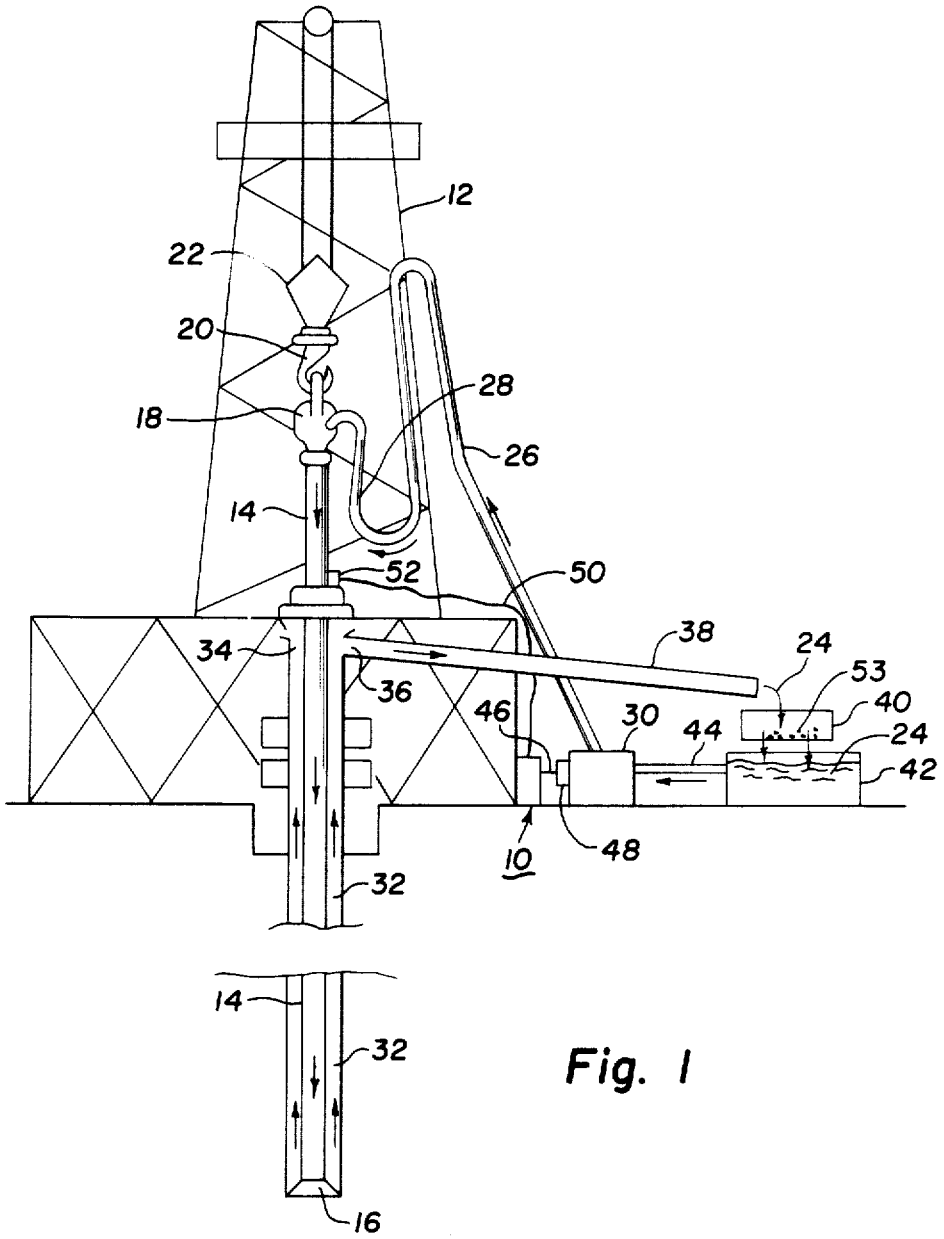
FIG. 1 shows schematically a well installation during the drilling operation and represents the locations of the various conventional elements of the drilling mud system.

Referring now to the drawing wherein like reference numerals designate like or corresponding elements throughout the several views, lag-determining apparatus is referred to generally by the reference numeral 10. The lag-determining apparatus 10 is shown in FIG. 1 in conjunction with a typical drilling mud system. With reference to FIG. 1, a typical well installation is illustrated and comprises a conventional derrick 12 with a drilling pipe assembly 14 which is provided at its lower end, at the bottom of the borehole or well, with a drill bit 16. At the upper end of the drilling pipe assembly 14 is located a swivel 18 which is suspended at the hook 20 of a movable block 22. The drilling mud 24 is injected into the drill string at the swivel 18 through a stand pipe 26 and a Kelly hose 28. The drilling mud 24 being transported by mud pump or pumps 30 which are located at the upstream side of the stand pipe. The drilling mud 24 flows downwardly within the drill pipe assembly, passes through the orifices in the drill bit 16 and then flows upwardly through an annular space 32 toward the head 34 of the well. The drilling mud 24 then flows through a so-called "flo line" 36 which dumps into a small mud reservoir called a "possum belly" and then flows onto shaker screen 40. From the shaker screen 40, the drilling mud 24 passes into a fluid pit or pits 42 which are sized to store a predetermined volume of drilling mud 24 and have an outlet pipe or conduit 44 to the suction side of the mud pump or pumps 30. The lag-determining apparatus 10 is operatively connected by cable 46 to pump stroke sensor or sensors 48 which are operatively connected to the mud pump or pumps 30. The lag-determining apparatus 10 is also operatively connected by cable 50 to the depth sensor 52. The borehole cuttings 53 are momentarily retained on the surface of the shaker screen 40. It will be appreciated that the lag-determining apparatus 10 is not required to be located on the derrick 12 but could be placed at a remote location as long as the apparatus could be connnected by appropriate cables.

Figure 2:
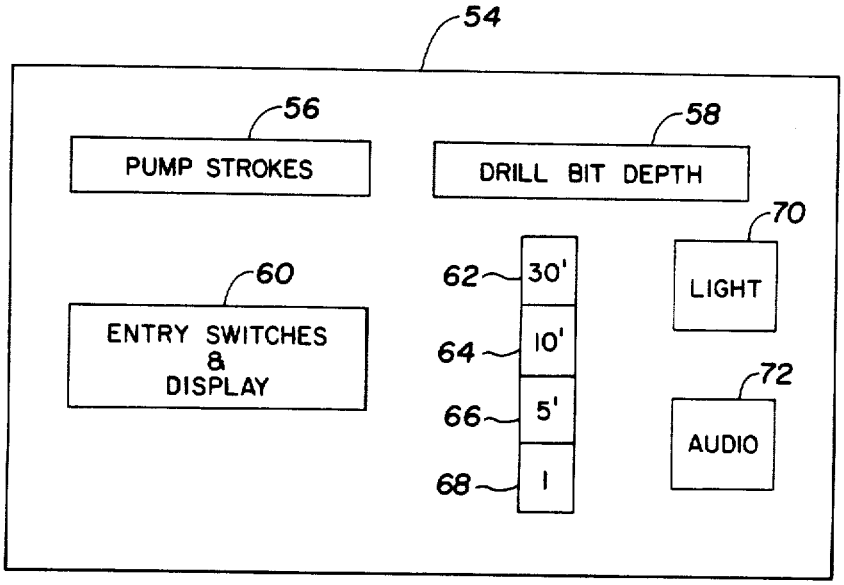
FIG. 2 shows the front panel of the unit encompassing the present invention.

FIG. 2 shows the front panel 54 of the lag-determining apparatus 10 as seen by an operator using the apparatus. The front panel 54 includes a pump stroke display 56 which provides a read-out of the total strokes of the mud pump or pumps 30. Also included is a cutting depth or drill bit depth display 58 which provides a read-out of the depth in feet of the drill bit 16 at time of desired sampling. Thumb wheel entry switches and display 60 allows the operator to enter and display a predetermined number of lag strokes into the lag-determining apparatus 10. Lag strokes are defined as being the number of strokes of the mud pump or pumps 30 which are required to displace cause the drilling mud to lift the borehole cuttings at the bottom of the borehole up to the surface of the earth where, the borehole cuttings may be identified as originating from the depth selected and be examined and evaluated. The mud pump or pumps 30 are positive displacement type pumps in which the amount of displacement per stroke is the same and is independent of the speed of the pump. Depth increment switches 62–68 are arranged vertically on the front panel 54 to allow the designation of intervals of drill bit depth of thirty feet, ten feet, five feet and one foot, respectively. A visual or light alarm display 70 and an audio alarm device 72 are included on the front panel 54.

Figure 3:
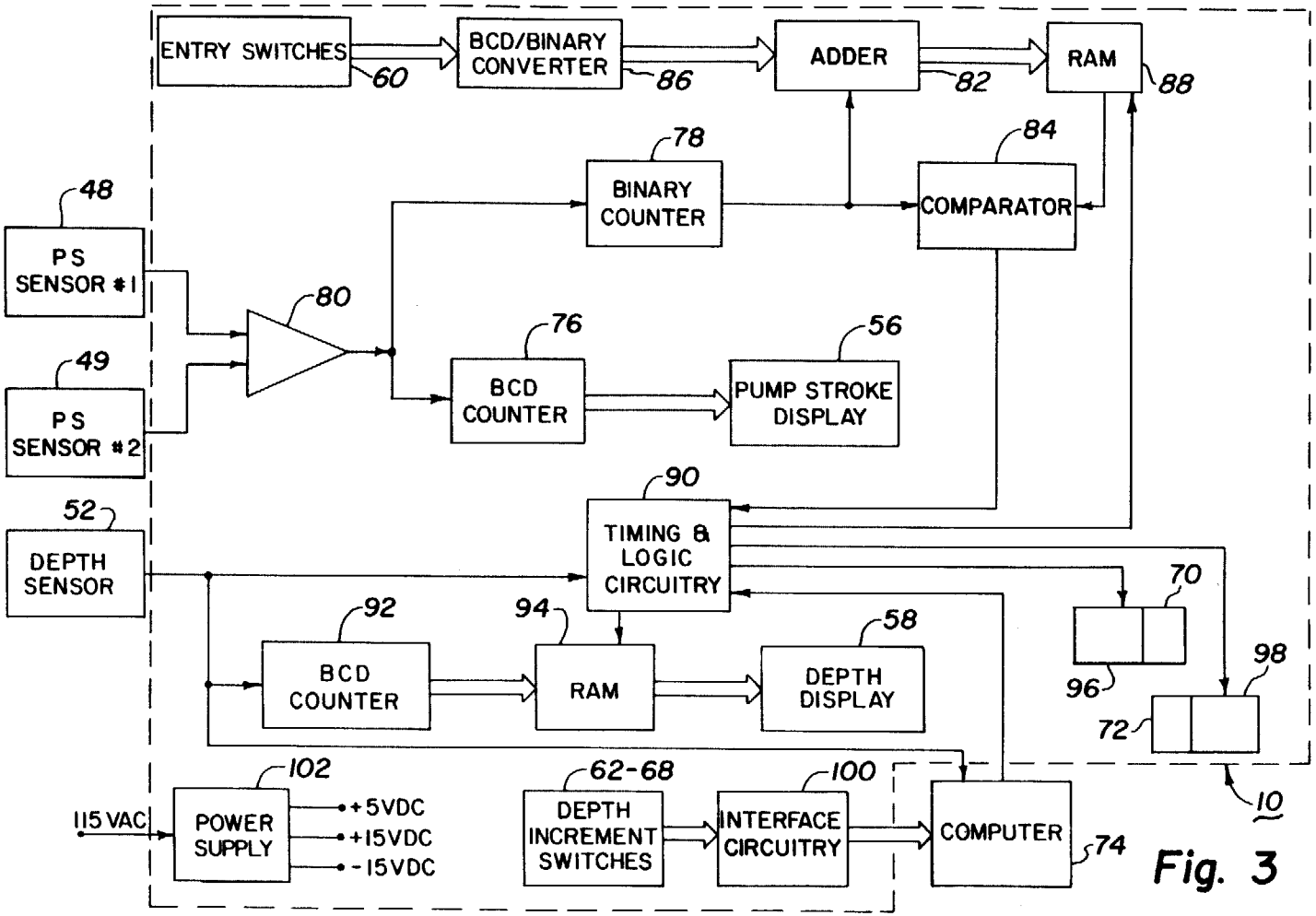
FIG. 3 is a simplified block diagram schematic of the present invention.

FIG. 3 shows a simplified block diagram schematic of the present invention for determining when and providing an indication of when the borehole cuttings from preselected depths arrive at the surface of the earth for examination and evaluation. The lag-determining apparatus 10 is externally interconnected with pump stroke sensors 48 and 49, depth sensor 52 and computer 74. In the preferred embodiment, computer 74 comprises a personal computer but it will be appreciated that the computer and computing function could be incorporated as an integral portion or element of the lag-determining apparatus 10. The outputs of pump stroke sensors 48 and 49 are provided as a pulse for each positive stroke of each pump and are input to BCD (Binary Coded Decimal) counter 76 and to binary counter 78 through gating device 80. The BCD output of the BCD counter 76 drives pump stroke display 56 which displays the total pump strokes of the multiple number of pumps. It will be appreciated that if only one mud pump is being utilized, then the total pump strokes displayed will be for that one pump. The output of binary counter 78 is provided as one binary input to adder circuitry 82 and as one binary input to the comparator 84.

The BCD output from the thumb wheel entry switches and display 60 represents the predetermined number of lag strokes entered therein and is input to the BCD/binary converter 86 whose output is provided as another binary input to adder circuitry 82. Adder circuitry 82 sums the binary representation of the total pump strokes to the binary representation of the lag strokes. The output of the adder circuitry 82 is input to RAM (Random-Access Memory) circuitry 88 which also receives another input from the timing and logic circuitry 90 which determines and controls when the value received from the adder circuitry 82 will be stored in RAM circuitry 88. The value from the adder circuitry 82 will be stored in the RAM circuitry 88 at the initiation of the process for determining when the borehole cuttings will arrive at the surface from a particular depth or increment of depth for observation and evaluation. The output of RAM circuitry 88 is provided as another binary input to comparator 84 which compares the binary output from RAM crcuitry 88 with the binary representation of the total pump strokes received from binary counter 78. The output of comparator 84 is provided as one input to the timing and logic circuitry 90 when the value of the total pump strokes is equal to the value of the sum of the predetermined number of lag strokes entered into the thumb wheel entry switches and display 60 and the number of pump strokes at the initiation of the process for determining when the borehole cuttings will arrive at the surface of the earth.

The binary output of depth sensor 52 is provided as an input to the computer 4 and also to BCD counter 92 whose output is provided at one input to RAM circuitry 94 which also has another input from the timing and logic circuitry 90. The input from the timing and logic circuitry 90 determines and controls when the input value from the BCD counter 92 will be stored in RAM circuitry 94. The output of RAM circuitry 94 drives the cutting depth display 58 and updates the display with each new value stored in the RAM circuitry 94. Timing and logic circuitry 90 receives an input store signal from computer 74 which provides the command for the timing and logic circuitry 90 to provide an input store signal to RAM circuitry 88 and RAM circuitry 94 at the appropriate times. Timing and logic circuitry 90 also provides an output to the visual alarm circuitry 96 and an output to the audio alarm circuitry 98. The outputs of depth increment switches 62–68 are provided to computer 74 through interface circuitry 100 which in the preferred embodiment is multiplexer circuitry. The necessary voltages for operation of the present invention are supplied by power supply 102. Computer 74 is provided with a state-of-the-art program to perform the necessary calculations and provide the necessary control signals to the lag-determining apparatus 10.

With respect to the operation of the present invention and with reference to FIGS. 2 and 3, the operator must initialize or calibrate the lag-determining apparatus 10 prior to the usage thereof in the drilling process. The operator must obtain the value of lag strokes for the particular drilling depth when the lag-determining apparatus 10 is to be initially brought on-line to be used with the drilling system. This initialization information may be obtained by the prior art carbide method but with one primary difference wherein the number of lag strokes are counted rather than keeping a record of the amount of time involved. The volume of mud pumped for each stroke of the positive displacement mud pump is known. It will be appreciated that any identifiable material could be substituted for the prior art carbide, e.g. colored rags, etc. in the obtaining of the number of lag strokes.

When the number of lag strokes have been determined, the operator will enter the number of lag strokes into the lag-determining apparatus 10 by operation of the thumb wheel entry switches and display 60. Let it be assumed that the number of lag strokes is one thousand. The operator will when place one of the depth increment switches 62–68 to the on position. Generally the depth increment switches for the greater increments (thirty feet and ten feet) are used at shallow drilling depths since the drilling proceeds at a fast rate of drilling depth at the shallow depths while the small increments (five feet and one foot) are used at the deeper drilling depths. Let it be assumed that the operator places the depth increment switch 64, which represents ten foot increments, in the on position which results in a signal being sent to the computer 74 that the ten foot increment has been chosen. Let it be assumed that the drill bit 16 is at four thousand feet, which value will be sent from the depth sensor 52 to BCD counter 92 and to the computer 74. Let it be assumed that the pump stroke display 56 shows twenty thousand. Upon receipt of the value of the depth of the drill bit, the computer 74 reads the input depth value and divides that input depth value by ten. When the input depth value is divisible by ten, which occurs at four thousand and ten feet, the computer 74 sends a store signal to the timing and logic circuitry 90. The timing and logic circuitry 90 then sends a store signal to RAM circuitry 88 which will store the value which is received from adder circuitry 82. The timing and logic circuitry 90 also sends a store signal to RAM circuitry 94 which will store the value of the drill depth received from BCD counter 92.

It will be appreciated that while the drilling depth has increased by ten feet the pump strokes have also increased during this drilling period. It will be assumed that the pump strokes read twenty thousand five hundred at the time the store signal was received by RAM circuitry 88; therefore, the value stored in the RAM circuitry 88 will be twenty one thousand five hundred which is the sum of the total pump strokes and the lag strokes.

The binary representation for twenty one thousand five hundred is provided by RAM circuitry 88 as one input to comparator 84. The other input to comparator 84 is the binary input from binary counter 78 which represents the total pump strokes of twenty thousand five hundred. Binary counter 78 will continue to increment upwardly as the total number of pump strokes increase until the total number of pump strokes equal twenty one thousand five hundred. At that time the comparator 84 will provide an output to the timing and logic circuitry 90 which will then provide an output to the visual alarm circuitry 96 resulting in the visual alarm display 70 being activated. An output from the timing and logic circuitry 90 is also provided to the audio alarm circuitry 98 resulting in the activation of the audio alarm device 72 which along with the visual alarm display 70 will provide an indication that borehole cuttings from the depth of four thousand ten feet have arrived at the surface of the earth. At this time, the value of the drill depth stored in RAM circuitry 94 will be passed to and displayed by cutting depth display 58.

This determination process continues for each drill depth value which is divisible by ten and the cycle described above is repeated so that the drill operator may observe the borehole cuttings at every ten foot interval of drill depth. It will be appreciated that the cycle will be the same for the other depth increments of thirty, five and one.

Although the present invention has been described in conjunction with specific forms thereof, it is evident that many alternatives, modifications and variations will be apparent to those skilled in the art in light of the foregoing disclosure. Accordingly, this description is to be construed as illustrative only and is for the purpose of teaching those skilled in the art the manner of carrying out the invention. It is understood that the forms of the invention herewith shown and described are to be taken as the presently preferred embodiment. Various changes may be made in the shape, size and arrangement of parts. For example, equivalent elements may be substituted for those illustrated and described herein, parts may be reversed, and certain features of the invention may be utilized independently of other features of the invention. It will be appreciated that various modifications, alternatives, variations, etc., may be made without departing from the spirit and scope of the invention as defined in the appended claims.

What is claimed is:

1. A method for determining the arrival at the surface of an identifiable material from a predetermined drilling depth independent of pump stroke rate and intermittent operations during the utilization of at least a drill bit, a positive displacement mud pump and drilling mud during the drilling of a well, said method comprising the steps of:

adding identifiable material to the drilling mud as the drilling mud is being pumped downwardly into the well;

initiate count of the pump strokes of the positive displacement mud pump as the previous step occurs;

observe arrival of the identifiable material at the surface of the earth as the drilling mud exits from the well;

observe the accumulated count of the pump strokes of the positive displacement mud pump which occur between step one and step three;

substract, from the accumulated count of the previous step, the number of pump strokes of the positive displacement mud pump required to pump the identifiable material down to the drill bit to establish a number of lag strokes; and utilize the number obtained in the previous step to identify the arrival of drill cuttings from a predetermined depth.

2. A method for determing the arrival, on the surface of the earth, of borehole cuttings from a predetermined drilling depth independent of pump stroke rate and intermittent operations during the utilization of at least a drill bit, a positive displacement mud pump and drillng mud during the drilling of a well, said method comprising the steps of:

determining the lag strokes for a predetermined drilling depth;

selecting a predetermined drilling depth increment which is to be added to said predetermined drilling depth;

determining the arrival of the drill bit at a drilling depth equal to the predetermed drilling depth plus the predetermined drilling depth increment;

counting the number of strokes of the positive displacement mud pump during the travel of the drill bit to the drilling depth equal to the predetermined drilling depth plus the predetermined drilling depth increment;

adding the number of strokes of the positive displacement mud pump fo the previous step to the lag strokes;

comparing the value of the number of strokes of the positive displacement mud pump accumulated since the second step with the value of the number of strokes obtained in the previous step;

providing a signal that the borehole cuttings have arrived on the surface of the earth when the compared values of the previous step are equal.

3. Lag-determining apparatus for determining the arrival, on the surface of the earth, of borehole cuttings from a predetermined drilling depth independent of pump stroke rate and intermittent operations during the utilization of at least a drill bit, a positive displacement mud pump and drilling mud during the drilling of a well, said lag-determining apparatus comprising:

means for entering a signal representative of the lag strokes for a predetermined drilling depth;

means for entering a signal representative of a predetermined drilling depth increment;

means for receiving a signal representative of the actual depth of the drill bit and determining when said drill bit arrives at a depth equal to the predetermined drilling depth plus a multiple of the drilling depth increment;

means for accumulating a count of the number of strokes of the positive displacement mud pump;

means for receiving and summing the accumulated count of the strokes of the positive displacement mud pump and the number of the lag strokes for the predetermined drilling depth;

means for comparing the value of the number of accumulated strokes of the positive displacement mud pump to the sum of the lag strokes plus the number of acccumulated strokes of the positive displacement mud pump at the predetermined drilling depth; and means for indicating the arrival of the borehole cutting on the surface, which occurs when the values compared by the means for comparing are equal.

4. The apparatus of claim 3 further including storage means operatively connected to receive an output of said means for receiving and summing and to provide said received output to said means for comparing.

5. The apparatus of claim 4 wherein said storage means comprises random access memory circuitry.

6. The apparatus of claim 4 further including timing and logic means to provide a signal to said storage means to control the time when said storage means stores the output from said means for receiving and summing.

7. The apparatus of claim 3 wherein said means for receiving and determining includes computing means.

8. The apparatus of claim 3 wherein said means for indicating includes a visual display.

9. The apparatus of claim 3 wherein said means for indicating includes an audio alarm.

10. The apparatus of claim 3 further including means to visually display the accumulated count of the strokes of the positive displacement mud pump.

11. The apparatus of claim 6 further including storage means operatively connected to receive a signal representative of the actual depth of the drill bit, said storage means being operatively connected to said timing and logic means to receive a signal to control the time when the actual depth of the drill bit is to be stored.

12. The apparatus of claim 11 further including means to visually display the actual depth of the drill bit.

13. The apparatus of claim 3 wherein said means for entering a signal representative of the lag strokes comprises switch means.

14. The apparatus of claim 3 wherein said means for entering a signal representative of a predetermined drilling depth increment comprises switch means.

15. The apparatus of claim 3 wherein said means for accumulating a count comprises a counter means.

16. The apparatus of claim 3 wherein said means for receiving and summing comprises adder means.

17. The apparatus of claim 3 wherein said means for comparing comprises a comparator.

* * * * *

UNITED STATES PATENT AND TRADEMARK OFFICE

CERTIFICATE OF CORRECTION

PATENT NO. : 4,708,212

DATED : November 24, 1987

INVENTOR(S) : James A. McAuley et al

It is certified that error appears in the above-identified patent and that said Letters Patent is hereby corrected as shown below:

IN THE SPECIFICATION

Column 1, line 15, after "location", insert a period.

Column 4, line 15, after "displace" insert -- the volume of drill string well bore annulus or to --.

Column 5, line 14, change "4" to -- 74 --.

Column 5, line 15, change "at" to -- as --.

Column 5, line 60, change "when" to -- then --.

IN THE CLAIMS

Column 7, line 56, change "fo" to -- of --.

Column 8, lines 25 and 26, change "cutting" to -- cuttings --.

Column 8, line 34, change "4" to -- 3 --.

Signed and Sealed this

Twenty-eighth Day of June, 1988

*Attest:*

*Attesting Officer*

DONALD J. QUIGG

*Commissioner of Patents and Trademarks*